US008307653B2

(12) United States Patent
Anoshkina et al.

(10) Patent No.: US 8,307,653 B2
(45) Date of Patent: Nov. 13, 2012

(54) COMBINED CATALYSTS FOR THE COMBUSTION OF FUEL IN GAS TURBINES

(75) Inventors: Elvira V. Anoshkina, Winter Springs, FL (US); Walter R. Laster, Oviedo, FL (US)

(73) Assignee: Siemens Energy, Inc., Orlando, FL (US)

( * ) Notice: Subject to any disclaimer, the term of this patent is extended or adjusted under 35 U.S.C. 154(b) by 956 days.

(21) Appl. No.: 12/363,923

(22) Filed: Feb. 2, 2009

(65) Prior Publication Data

US 2010/0192592 A1 Aug. 5, 2010

(51) Int. Cl.
*F02C 7/264* (2006.01)

(52) U.S. Cl. ..... 60/723; 60/39.822; 60/777; 431/268

(58) Field of Classification Search ..... 60/39.822, 60/723, 777; 431/7, 170, 268, 326, 328
See application file for complete search history.

(56) References Cited

U.S. PATENT DOCUMENTS 3,945,947 A 3/1976 Sakai et al.
4,072,007 A * 2/1978 Sanday ..... 60/723
5,183,401 A * 2/1993 Dalla Betta et al. ..... 431/7
5,281,128 A * 1/1994 Dalla Betta et al. ..... 431/7
5,593,647 A 1/1997 Kirby
6,054,108 A 4/2000 Eckardt et al.
6,174,159 B1 * 1/2001 Smith et al. ..... 431/7
6,365,118 B1 4/2002 Kharas et al.
6,948,926 B2 9/2005 Valentine et al.
7,086,235 B2 * 8/2006 Von Arx et al. ..... 60/777
7,101,639 B2 9/2006 Gorer et al.
7,262,334 B2 8/2007 Schmidt et al.
7,431,905 B2 10/2008 Hancu et al.
2004/0224842 A1 11/2004 Wallace et al.
2006/0225429 A1 * 10/2006 Szedlacsek et al. ..... 60/777

* cited by examiner

*Primary Examiner* — Ehud Gartenberg
*Assistant Examiner* — Steven Sutherland

(57) ABSTRACT

A catalytic oxidation module for a catalytic combustor of a gas turbine engine is provided. The catalytic oxidation module comprises a plurality of spaced apart catalytic elements for receiving a fuel-air mixture over a surface of the catalytic elements. The plurality of catalytic elements includes at least one primary catalytic element comprising a monometallic catalyst and secondary catalytic elements adjacent the primary catalytic element comprising a multi-component catalyst. Ignition of the monometallic catalyst of the primary catalytic element is effective to rapidly increase a temperature within the catalytic oxidation module to a degree sufficient to ignite the multi-component catalyst.

20 Claims, 6 Drawing Sheets

COMBINED CATALYSTS FOR THE COMBUSTION OF FUEL IN GAS TURBINES

STATEMENT REGARDING FEDERALLY SPONSORED DEVELOPMENT

Development for this invention was supported in part by Contract No. DE-FC26-03NT41891, awarded by the United States Department of Energy. Accordingly, the United States Government may have certain rights in this invention.

FIELD OF THE INVENTION

The present invention relates generally to a catalytic oxidation module for a gas turbine engine combustor, and more particularly to a catalytic oxidation module comprising at least one primary catalytic element having a monometallic catalyst adjacent to a plurality of secondary catalytic elements having a multi-component catalyst. Initial ignition of the at least one primary catalytic element is effective to rapidly increase a temperature within the catalytic oxidation module to a degree sufficient to ignite the multi-component catalyst of the plurality of adjacent secondary catalytic elements, which possess durable long-term-performance characteristics. When a full set of catalysts is ignited, the effective partial oxidation of fuel may be achieved in the catalytic oxidation module of a catalytic combustor.

BACKGROUND OF THE INVENTION

Catalytic combustion systems are well known in gas turbine applications to reduce the formation of pollutants in the combustion process. As known, gas turbine engines include a compressor for compressing air, a combustion stage for producing a hot gas by burning fuel in the presence of the compressed air, and a turbine for expanding the hot gas to extract shaft power. Catalytic oxidation reactions involve the flowing of a mixture of fuel and air over a catalytic material and the reaction of the fuel, e.g. methane, syngas, with the catalytic material to release the partially-oxidized fuel components back to the fuel-air mixture. Partial pre-oxidation of the fuel prior of final burning helps to control the stability and efficiency of fuel burning in the combustor, and helps to significantly reduce the amount of developed $NO_x$ to below the 3 ppm level.

U.S. Pat. No. 6,174,159 describes a catalytic oxidation method and apparatus for a gas turbine engine utilizing catalytic combustion with a backside cooled design. In such combustors, multiple cooling conduits, such as tubes, are coated on the outside diameter with a catalytic material and are disposed in a catalytic reactor portion of the combustor. A small portion of air is mixed with fuel, then the mixture is directed over the conduits coated with catalytic material, and, as a result of an exothermic catalytic reaction of fuel species with the catalytic material, fuel is partially oxidized. Simultaneously, a main portion of air is separated by being passed through the conduits. The main portion of air has a temperature much lower than the temperature developed on the surface of catalytic elements and serves as a cooling media in the catalytic module. The hot, partially-oxidized fuel-air mixture then exits the catalytic chamber and is mixed with the cooling air that was directed through tubes, creating a uniformly heated, partially pre-oxidized, and homogeneous combustible mixture.

Multi-component or heterogeneous catalysts comprising a combination of metals and metal oxides have recently been employed as the catalytic material in a number of catalytic combustion systems because of their advantages over monometallic catalysts. For example, a Pt—Pd catalyst system provides improved stability compared to a monometallic catalyst (Pd or Pt only) system and the Pt—Pd catalyst system is able to oxidize methane at a higher rate than a monometallic catalyst system. One drawback, however, for many catalytic systems is that they typically have high ignition temperatures or temperatures at which the catalytic reaction is able to be started. Ignition or start-up temperature of catalytic reaction is an important characteristic of a catalyst. Catalyst ignition starts the partial oxidation of fuel. When attempting to ignite at lower temperatures, e.g. at temperatures of the compressed air fed from the compressor outlet of the engine, higher concentrations of active components in a catalytic material are required to start the catalytic reaction. Thus, another drawback of known catalyst systems employing any catalytic system is that they require substantial amounts of expensive transition metals to obtain a start-up of catalytic reactions at such lower temperatures. There remains a need for low cost catalytic systems that meet low temperature ignition criteria.

BRIEF DESCRIPTION OF THE DRAWINGS

The invention will be more apparent from the following description in view of the drawings that show.

DETAILED DESCRIPTION OF THE INVENTION

The present invention is directed to novel and improved catalytic oxidation modules and methods that provide a gas turbine engine combustor with improved catalytic performance and high catalytic stability. Generally, known catalytic oxidation modules require high temperatures to ignite a multi-component catalyst. The inventors have surprisingly found that the benefits of a multi-component catalytic system may be achieved while the amount of catalytic material needed in the system may be reduced via the strategically placing of monometallic catalytic elements among adjacent multi-component catalytic elements. In this way, ignition of the monometallic catalyst may be realized at a temperature near the incoming stream of compressed air in a combustion engine, e.g. 300-400° C., and thereafter, upon ignition of the monometallic catalyst, the temperature within the catalytic oxidation modules rapidly increases (due to exothermic reactions) to a degree sufficient to ignite the durable multi-component catalyst. The present invention thus substantially reduces the temperature necessary to start a catalytic reaction, as well as substantially reduces the concentration of expensive transition metals in catalysts required for ignition at lower temperatures.

Figure 1:
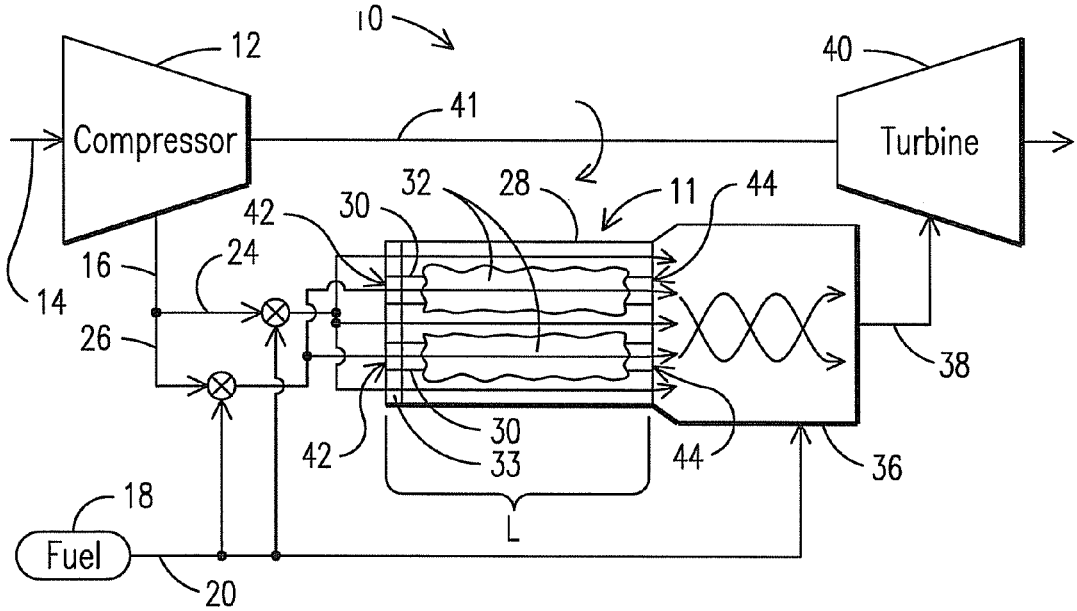
FIG. 1 is a functional diagram of a catalytic oxidation module in a gas turbine engine in accordance with an aspect of the present invention.

Now referring to the drawings, FIG. 1 illustrates an embodiment of the present invention. A gas turbine engine 10 is shown as including a combustor 11 and a compressor 12 for receiving a flow of filtered ambient air 14 and for producing a flow of compressed air 16. The compressed air 16 is separated into a combustion mixture fluid flow 24 and a cooling fluid flow 26, respectively, for introduction into a catalytic oxidation module 28 of the combustor 11. The combustion mixture fluid flow 24 is mixed with a flow of a combustible fuel 20, such as natural gas, methane, syngas, or fuel oil, provided by a fuel source 18, prior to introduction into the catalytic oxidation module 28. The cooling fluid flow 26 may be introduced directly into the catalytic oxidation module 28 without mixing with the combustible fuel 20. Optionally, the cooling fluid flow 26 may be mixed with the flow of combustible fuel 20 before being directed into the catalytic oxidation module 28.

Inside the catalytic oxidation module 28, the combustion mixture fluid flow 24 and the cooling fluid flow 26 are separated, for at least a portion of the travel length. L, by one or more catalytic elements, such as tubular elements 30 as shown, having respective inlet ends 42 and outlet ends 44. The tubular elements 30 may be retained in a spaced apart relationship by a tubesheet 33. Alternatively, the tubular elements 30 may be maintained in a spaced apart relationship by any other suitable structure or method known in the art, such as that disclosed in U.S. application Ser. No. 11/101,248, published as 2006/0225429, the entirety of which is hereby incorporated by reference.

The tubular elements 30 are coated with a catalyst 32 on a side exposed to the combustion mixture fluid flow 24. As will be explained in detail below, the catalyst 32 may be a monometallic catalyst or multi-component catalyst. In an embodiment, the tubular elements 30 are coated on respective outer diameter surfaces with the catalyst 32 to be exposed to a combustion mixture fluid flow 24 traveling around the outer diameter surfaces of the tubular elements 30. Typically, the catalyst 32 comprises one or several catalytically-active metals or metal oxides dispersed in a porous support material, e.g. modified alumina. Optionally, a bonding layer (not shown) is provided between the catalyst 32 and the underlying substrate. In a backside cooling arrangement, the cooling fluid flow 26 is directed to travel through the interior of the tubular elements 30 and out the outlet ends of the tubular elements 30. While exposed to the catalyst 32, the combustion mixture fluid flow 24 exothermically reacts with the catalyst 32 and, as a result of the reaction, fuel is partially oxidized. The tubular elements 30 are cooled by the unreacted cooling fluid flow 26, thereby absorbing a portion of the heat produced by the exothermic reaction. In this way, the tubular elements 30 receive a fuel mixture over the outer diameter surface thereof and discharge a partially oxidized fuel mixture at respective ends thereof. Alternatively, the tubular elements 30 may be coated on the respective interior surfaces with a catalyst 32 to expose a combustion mixture fluid flow 24 traveling through the interior of the tubular elements 30, while the cooling fluid flow 26 travels around the outer diameter surfaces of the tubular elements 30.

After the flows 24, 26 exit the catalytic oxidation module 28, the flows 24, 26 are mixed and combusted in a plenum, or a combustion completion stage 36, to produce a hot combustion gas 38. In an embodiment of the invention, the flow of a combustible fuel 20 is provided to the combustion completion stage 36 by the fuel source 18. The hot combustion gas 38 is received by a turbine 40, where it is expanded to extract mechanical shaft power. A common shaft 41 may interconnect the turbine 40 with the compressor 12 as well as an electrical generator (not shown) to provide mechanical power for compressing the filtered ambient air 14 and for producing electrical power, respectively. The expanded combustion gas may be exhausted directly to the atmosphere or it may be routed through additional heat recovery systems (not shown).

Figure 2:
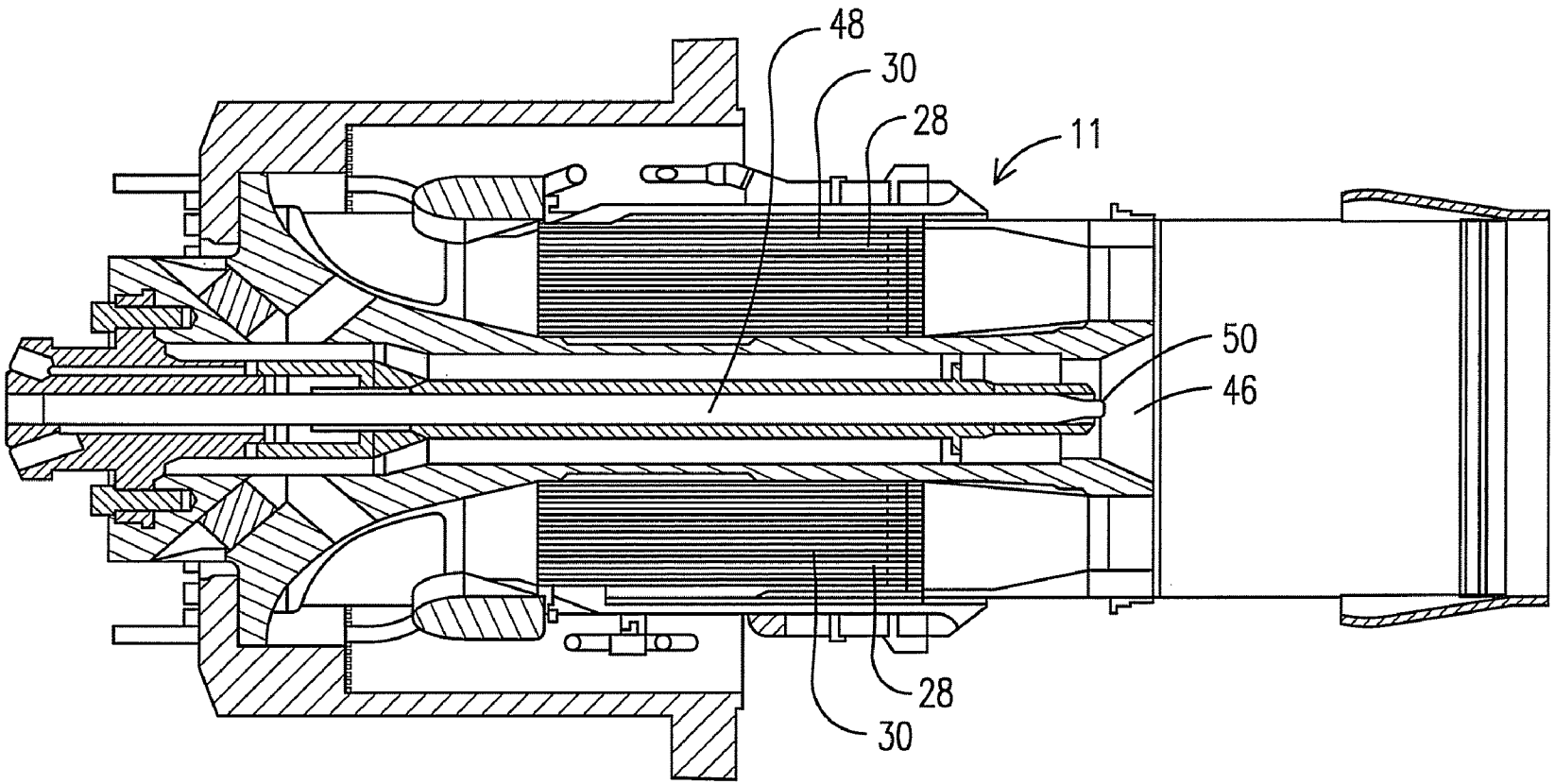
FIG. 2 illustrates a schematic diagram of a combustor with catalytic oxidation modules in accordance with an aspect of the present invention.

While FIG. 1 generally shows a single catalytic oxidation module 28 within a single combustor 11 for illustrative purposes, it is understood that gas turbine engines, e.g. gas turbine engine 10, generally comprise multiple combustors, e.g. sixteen. Each combustor, e.g. combustor 11, includes a plurality of the catalytic oxidation modules, e.g. catalytic oxidation module 28. In an embodiment, the combustor 11 includes six catalytic oxidation modules circumferentially disposed about a central axis of the combustor 11, each catalytic oxidation module 28 comprising several hundred tubular elements, e.g. 306, for a total amount of about two thousand tubular elements in the combustor 11, e.g. 1836. 1836. The total number of tubular catalytic elements in the engine could be in order of thirty thousands, e.g. 29,376. Typically, as shown in FIG. 2, the catalytic oxidation modules 28 of the combustor 11 comprising the tubular elements 30 may be held in place within the combustor 11 by a wagon wheel liner 46 or by any other suitable structure. The plurality of catalytic oxidation modules 28 are typically disposed circumferentially about a pilot nozzle 50 having a pilot cone for emitting a pilot flame.

Figure 3:
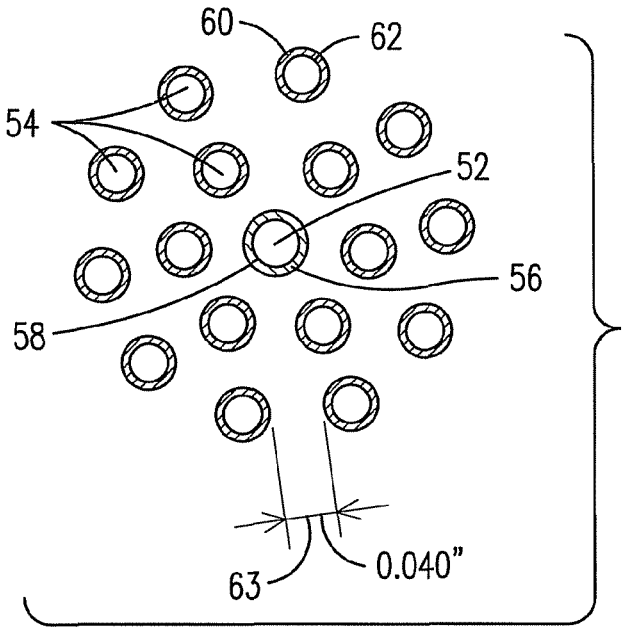
FIG. 3 is a side plan view of the concentric catalytic combustor showing a primary catalytic element surrounded by secondary catalytic elements in accordance with an aspect of the present invention.

FIG. 3 shows an exemplary embodiment of the present invention showing tubular elements 30 as comprising a primary catalytic element 52 and a plurality of secondary catalytic elements 54 adjacent the primary catalytic element 52. In operation, the adjacent secondary catalytic elements 54 are ignited solely or in part by the heat generated upon ignition of a respective primary catalytic element 52. In the embodiment shown in FIG. 3, a single primary catalytic element 52 is surrounded by a plurality of secondary catalytic elements 54, although it is understood that, within a single catalytic oxidation module, a plurality of primary catalytic elements 52 may be provided. Each of the primary catalytic elements 52 may be surrounded by a plurality of the secondary catalytic elements 54.

Referring to FIG. 3, the primary catalytic elements 52 may comprise a monometallic catalyst 56 coated on substantially all of, or on the entirety of, an outer diameter surface 58 of the primary catalytic element. The monometallic catalyst 56 may comprise a single catalytically active component dispersed in a matrix, such as a porous support material (washcoat) or within a porous thermal barrier coating. The monometallic catalyst 56 may comprise a precious metal, a Group VII noble metal, a Group VIII noble metal, a transition metal, a metal from the lanthanide series, a metal from the actinide series, a base metal, a metal oxide, a metal salt, or any other metal component. Exemplary monometallic catalysts include, but are not limited to, zirconium, vanadium, chromium, manganese, copper, platinum, palladium, osmium, iridium, rhodium, cerium, lanthanum, cobalt, nickel, iron, and the like, and oxides and sulfides thereof. In one embodiment, the monometallic catalyst may be one of platinum, palladium, ruthenium, and rhodium. Also, in an embodiment, the monometallic catalyst 56 may have a light off temperature over methane or natural gas of between 300° C. and 400° C., which is also the typical temperature of a compressed air stream flowing into the catalytic oxidation module 28. Accordingly, the primary catalytic elements 52 are designed to easily ignite without the need for added heat to the catalytic oxidation module 28.

Referring again to FIG. 3, in an embodiment, the secondary catalytic elements 54 may be coated with a multi-component catalyst 60 over at least a portion of an outer diameter surface 62 of the secondary catalytic elements 54. By "multi-component catalyst," it is meant a catalyst other than a monometallic catalyst, such as a catalyst comprising two or more catalytically active metals, metal salts, or metal oxides. The multi-component catalyst may be dispersed within a matrix, such as a porous support material (washcoat) or within a porous thermal barrier coating. In one embodiment, the multi-component catalyst 60 includes bi-metallic catalysts, such as Pt—Pd catalysts or other Pt-metal/metal oxide catalysts. In another embodiment, the multi-component catalyst 60 comprises at least three of the monometallic catalysts identified above. Thus, the multi-component catalyst 60 may comprise two, three, or an even greater number of catalyst components selected from the group of a precious metal, a Group VII noble metal, a Group VIII noble metal, a transition metal, a lanthanide metal, an actinide metal, a base metal, a metal salt, a single metal oxide, and a multi-metal oxide. In a particular embodiment, the multi-component catalyst 60 comprises at least three metals selected from the group consisting of platinum, palladium, ruthenium, and rhodium.

In an embodiment, the ratio of a total catalyst surface area of monometallic catalyst 56 to a total surface area ratio of multi-component catalyst 60 may be in the range of from about 1:10 to about 1:1000, and in another embodiment from 1:100 to 1:1000. It is understood, however, that these ratios may vary according to the activity of each catalyst and the particular design of the system. Further, in an embodiment, the multi-component catalyst 60 has a light off temperature of 400° C. or greater. Accordingly, temperatures about the multi-component catalyst 60, e.g. 300-400° C. may be initially insufficient to ignite the multi-component catalyst 60, but upon the ignition of the monometallic catalyst 56 at these temperatures, the heat generated due to the exothermic fuel-oxidation reaction on the monometallic catalyst 56 increases the surrounding temperature in the catalytic oxidation module 28 and around the multi-component catalyst 60 to a degree (e.g., >400° C.) sufficient to ignite the multi-component catalyst 60.

The monometallic catalyst 56 and the multi-component catalyst 60 may be deposited on the catalytic elements 52, 54 using any suitable technique known in the art, with or without a bond layer, and without, over, or within a porous coating. Conventional techniques for depositing catalytic coatings comprising the monometallic catalyst 56 and the multi-component catalyst 60 on the catalytic elements 52, 54 include slurry dipping, slurry spraying, slurry sputtering, electron beam physical vapor deposition (EB-PVD), chemical vapor deposition (CVD), and various thermal spray processes. Examples of thermal spray processes are high velocity oxy-fuel thermal spray (HVOF), plasma vapor deposition (PVD), low pressure plasma spray (LPPS), or atmospheric plasma spray (APS).

Although sixteen (16) secondary catalytic elements 54 are shown surrounding a single primary catalytic element 52 in FIG. 3, it is understood that ignition of one or more of the primary catalytic elements 52 increases the temperature within the catalytic oxidation module 28 to a degree sufficient to ignite an even greater number of the secondary catalytic elements 54. In one embodiment, in a module comprising 306 catalytic elements, e.g. catalytic oxidation module 28, the 306 catalytic elements may comprise a plurality of primary catalytic elements 52, which are provided with an amount of the monometallic catalyst 56 sufficient to ignite the multi-component catalyst 60 of a plurality of adjacent secondary catalytic elements 54. In one particular embodiment, the catalytic oxidation module 28 may include as few as four primary catalytic elements 52 distributed throughout a plurality of secondary catalytic elements 54. Upon ignition of the plurality of primary catalytic elements 52 at a lower temperature that is initially insufficient to ignite the multi-component catalyst 60, the generated heat increases the temperature in the catalytic oxidation module 28 to a degree sufficient to ignite the multi-component catalyst 60 of a plurality of adjacent secondary catalytic elements 54. It is understood, however, that any number of primary catalytic elements may be utilized to generate sufficient heat to ignite the remaining (primary and/or secondary) catalytic elements in the particular combustion module. It is understood that generally not all primary and secondary catalytic elements can ignite at the same time, therefore, a chain of ignitions may occur in the catalytic oxidation module.

In one embodiment, the primary catalytic elements 52 are disposed "adjacent to" the secondary catalytic elements 54. By "adjacent to," it is meant that upon ignition of the plurality of primary catalytic elements 52 at a lower temperature that is initially insufficient to ignite the multi-component catalyst 60, a secondary catalytic element 54 is located sufficiently close to a respective one of the primary catalytic elements such that the heat generated by the ignition of the monometallic catalyst 56 increases the temperature in the catalytic oxidation module 28 to a degree sufficient to ignite the multi-component catalyst 60 of a plurality of adjacent secondary catalytic elements 54. In one embodiment, gaps are provided between each of the primary and secondary catalytic elements 52, 54 to allow for efficient heat transfer between any of the catalytic elements 52, 54. In a particular embodiment, as shown in FIG. 3, gaps 63 have an approximate size of 0.040" between any adjacent catalytic elements 52, 54. It is understood however that the gaps or spacing between adjacent catalytic elements may be altered to obtain the desired heat transfer between catalytic elements.

Figure 4:
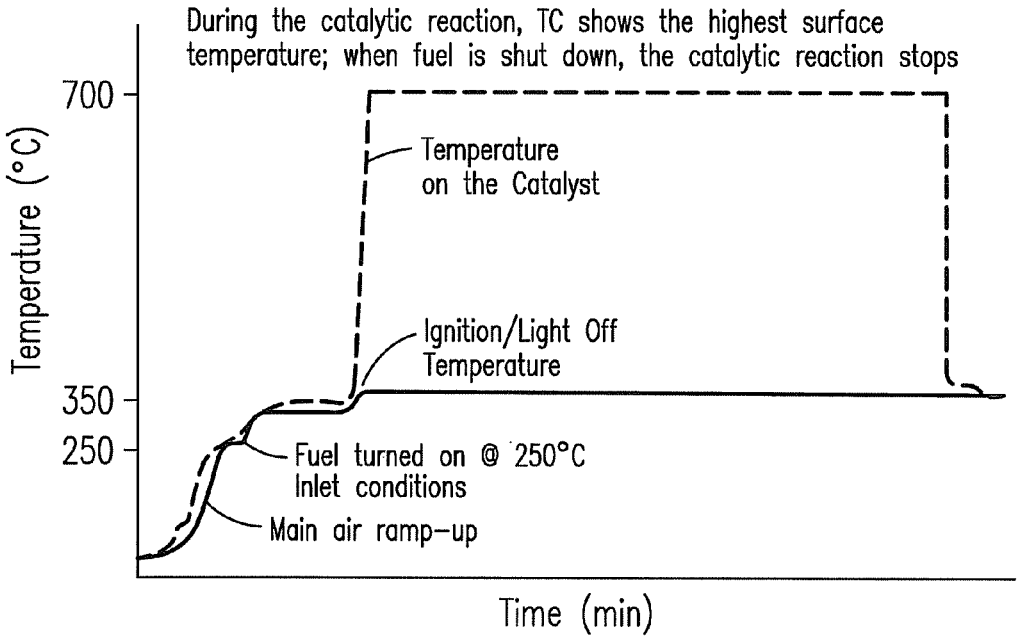
FIG. 4 is a graph showing the rapid increase in temperature upon ignition of a primary monometallic catalyst in accordance with an aspect of the present invention.

FIG. 4 illustrates the dramatic change in temperature upon ignition of the monometallic catalyst 56 deposited on the surface of tubular elements 30. First, the compressed air 16 is ramped up and the combustible fuel 20 was added to a portion of the compressed air 16 at about 250° C. to provide the combustion mixture fluid flow 24. The air temperature of the compressed air 16, and therefore the temperature of combustion fuel mixture continue to be ramped up. Thereafter, the combustion mixture fluid flow 24 flows over the tubular elements 30 and ignites the monometallic catalyst 56 on the primary catalytic element 52 at approximately 330° C. (the temperature of the compressed air 16 provided by compressor). As is particularly shown in FIG. 4, upon ignition of the primary catalytic elements 52, its surface area temperature increases from 330° C. to about 700° C. in a few seconds. As soon as the primary catalytic elements 52 ignite, the generated heat may be transferred to adjacent catalytic elements, i.e. secondary catalytic elements 54 via an increase of the temperature of the combustion mixture fluid flow 24 flowing within the gaps 63 to above 400° C. The hot fuel mixture provides the sufficient conditions to increase the temperature of adjacent secondary catalytic elements 54 to a degree for sufficient ignition of the multi-component catalyst 60 of the secondary catalytic elements 54. Secondary catalytic elements 54 comprise a significantly lower concentration of catalytic materials than monometallic primary catalytic elements 52, thereby realizing a significant savings in valuable catalytic materials. However, once the secondary catalytic elements 54 are ignited, the multi-component catalyst 60 of the secondary catalytic elements 54 serves as the main catalytic media for fuel oxidation (compared to the primary monometallic catalyst 56) and provide the stable and durable oxidation of fuel for a substantial period of time in the catalytic oxidation module 28.

Figure 5:
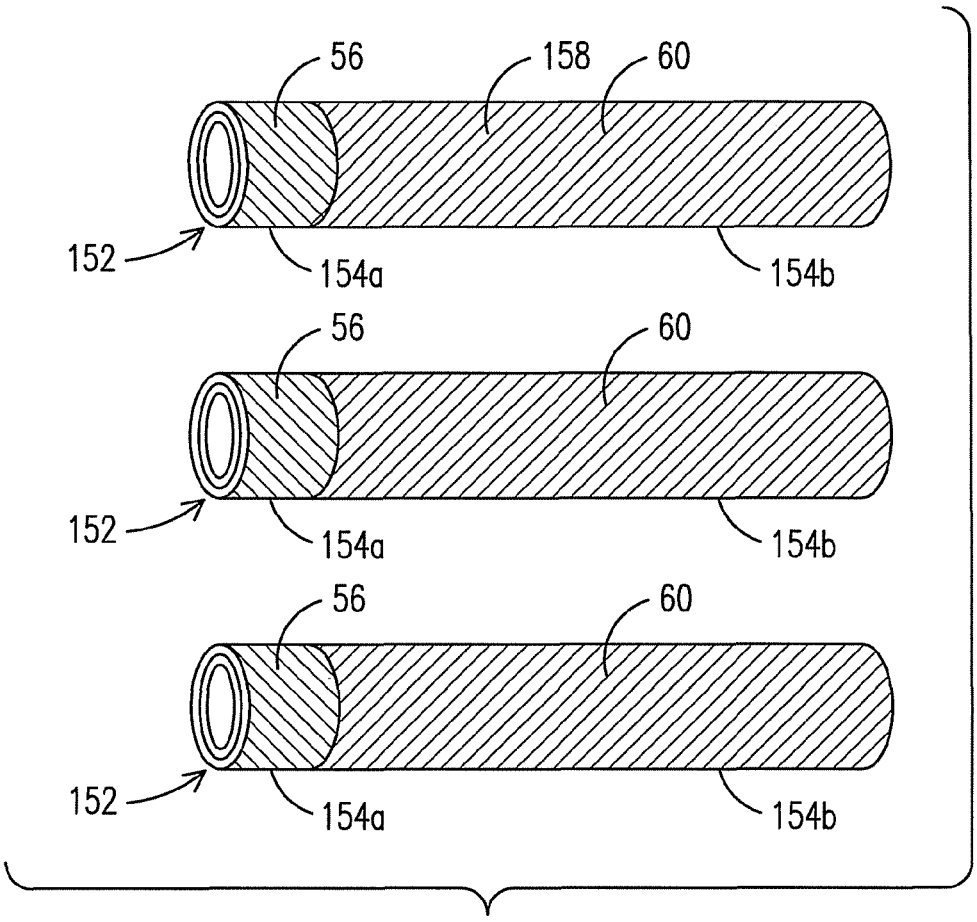
FIG. 5 is a side plan view of catalytic elements having segments of monometallic materials in accordance with an aspect of the present invention.

In an alternate embodiment, as shown in FIG. 5, there is shown a plurality of spaced-apart catalytic elements 152 comprising a monometallic catalyst 56 and multi-component catalyst 60. In this embodiment, since it is desirable to initiate the ignition of any catalytic materials toward an upstream end of a catalytic module, catalytic elements 152 comprise a monometallic catalyst 56 in at least a first segment 154*a*, which is disposed across outer diameter surfaces 158 of the catalytic element 152. The remaining outer diameter surface 158 of the catalytic element 152 may comprise a multi-component catalyst 60 as shown in segment 154*b*. All adjacent catalytic elements 152 are optionally similar as shown, and thus there may be no differentiation between primary catalytic elements and secondary catalytic elements as previously described herein. Upon ignition of the monometallic portion 56 of catalytic elements 152 at temperatures between 300° C. and 400° C. the multi-component catalyst 60 of the catalytic elements 152 may be ignited at temperatures above 400° C. upon the heat transfer from the ignited portion of the monometallic catalyst 56 on segment 154*a* and the common heating of the fuel mixture in the catalytic module. The catalyst surface area ratio of the monometallic catalyst 56 to the multi-component catalyst 60 on the catalytic elements 152 may be from 1:10 to 1:1000.

Alternatively, the catalytic elements 152 described herein may have periodically alternated stripes of monometallic and multi-component catalytic materials deposited along the lengths of the catalytic elements 152.

Figure 6:
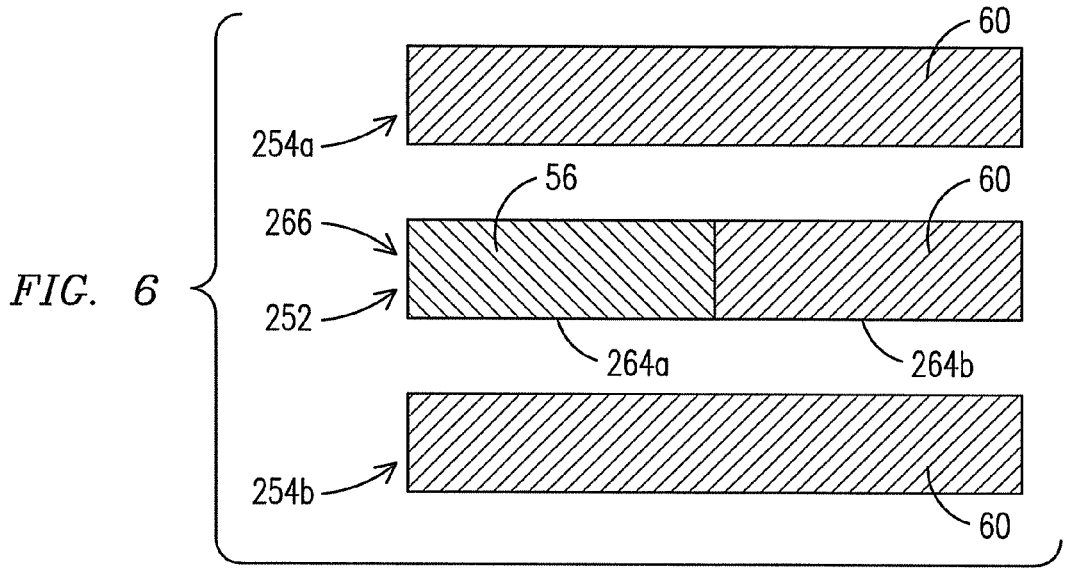
FIG. 6 is a side plan view of a primary catalytic element having a segment of a monometallic catalyst adjacent to a multi-component catalyst in accordance with an aspect of the present invention.

In yet another embodiment, as shown in FIG. 6, one or more primary catalytic elements 252 are provided with the monometallic catalyst 56 across a portion of the surface of the primary catalytic element 252. The remaining portion of the primary catalytic element 252 may comprise the multi-component catalyst 60, or may further include segments of the monometallic catalyst 56. For example, as shown, exemplary primary catalytic element 252 includes a first portion 264*a* of the monometallic catalyst 56 and a second portion 264*b* having solely the multi-component catalyst 60. A plurality of secondary catalytic elements 254 may be disposed adjacent to the primary catalytic element 252 and may comprise the multi-component catalyst 60. Further optionally, in this embodiment, a coating thickness of the monometallic catalyst 56 may be varied to provide a gradient of the monometallic catalyst 56 over a length of a portion comprising the monometallic catalyst 56. In one embodiment, the monometallic catalyst 56 has a greater thickness at a front end 266 of the primary catalytic element 252 relative to a downstream portion. As with previously described embodiments, ignition of the second portion 264*a* with catalyst 56 on the primary catalytic element 252 will be sufficient not only to ignite the multi-component catalyst 60 on adjacent secondary catalytic elements 254 as set forth herein, but may also quickly ignite the multi-component catalyst 60 of the multi-component segment 264*b* on the primary catalytic element 252. It is understood that a few primary catalytic elements described above may be provided in a catalytic oxidation module sufficient to ignite a relatively larger number of multi-component-containing secondary catalytic elements adjacent to the primary catalytic elements. In one embodiment, the catalyst surface area ratio of the monometallic catalyst 56 to the multi-component catalyst 60 may be from 1:10 to 1:1000.

Figure 7:
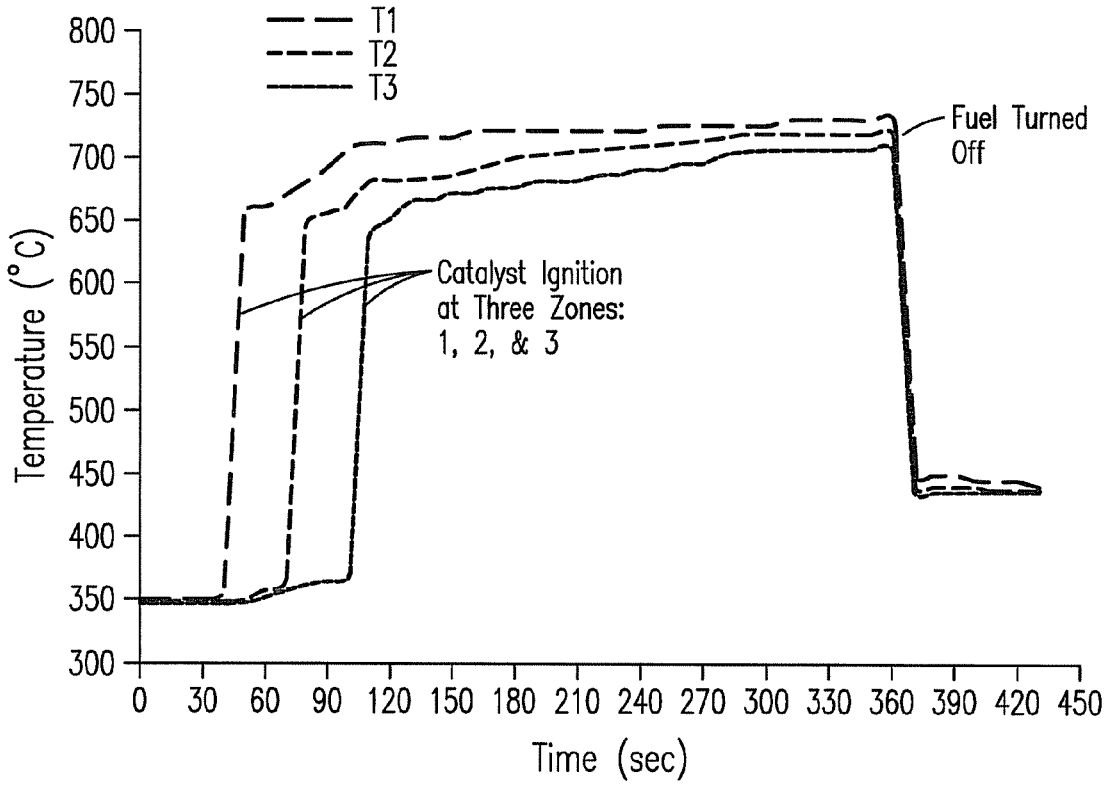
FIG. 7 is a graph showing the step-wise ignition of zones in a combustion module in accordance with an aspect of the present invention.

In FIG. 7, there is shown the stepwise ignition of the catalysts 56, 60 disposed on the catalytic elements 52, 54 in three zones (T1, T2, T3) in a downstream direction along the length of the catalytic oxidation module 28. The determination of the exact dimensions of each zone is not critical as FIG. 7 is provided to illustrate that the ignition of the monometallic 56 catalyst in each zone (T1, T2, T3) causes the temperature to rapidly increase along an entire length of the catalytic oxidation module 28 within a short period of time (<120 seconds) and the monometallic catalyst 56 consequently ignites completely within 1-3 minutes. While not wishing to be bound by theory, it is believed that the whole ignition of the monometallic catalyst 56 within 2-3 minutes, for example, is effective to increase a surface temperature of the catalytic element 52 along a longitudinal length of the catalytic element 52 to a temperature of up to 700° C. (and possibly higher) and, via heat transfer, is effective to increase a temperature of a fuel-air mixture flowing through gaps, e.g. gaps 63, between the catalytic elements 52, 54 and to increase a surface temperature of the secondary catalytic elements 54 to a temperature above 400° C. to stimulate the light-up of the multi-component catalyst 60 on the secondary catalytic elements 54. Therefore, collectively, the temperature is increased within the catalytic oxidation module 28 to such a degree that the multi-component catalyst 60 on the catalytic elements 54 (and 52 if any) is effectively ignited.

Although the catalytic elements are shown and described above as tubular elements, it is understood that the catalytic elements are not so limited to the above-described tubular elements 30. Alternatively, the catalytic elements may comprise any suitable catalytic element, such as a spaced tandem array of corrugated panels as set forth in U.S. Pat. No. 6,810,670, the entirety of which is hereby incorporated by reference, foils, or the like.

Figure 8:
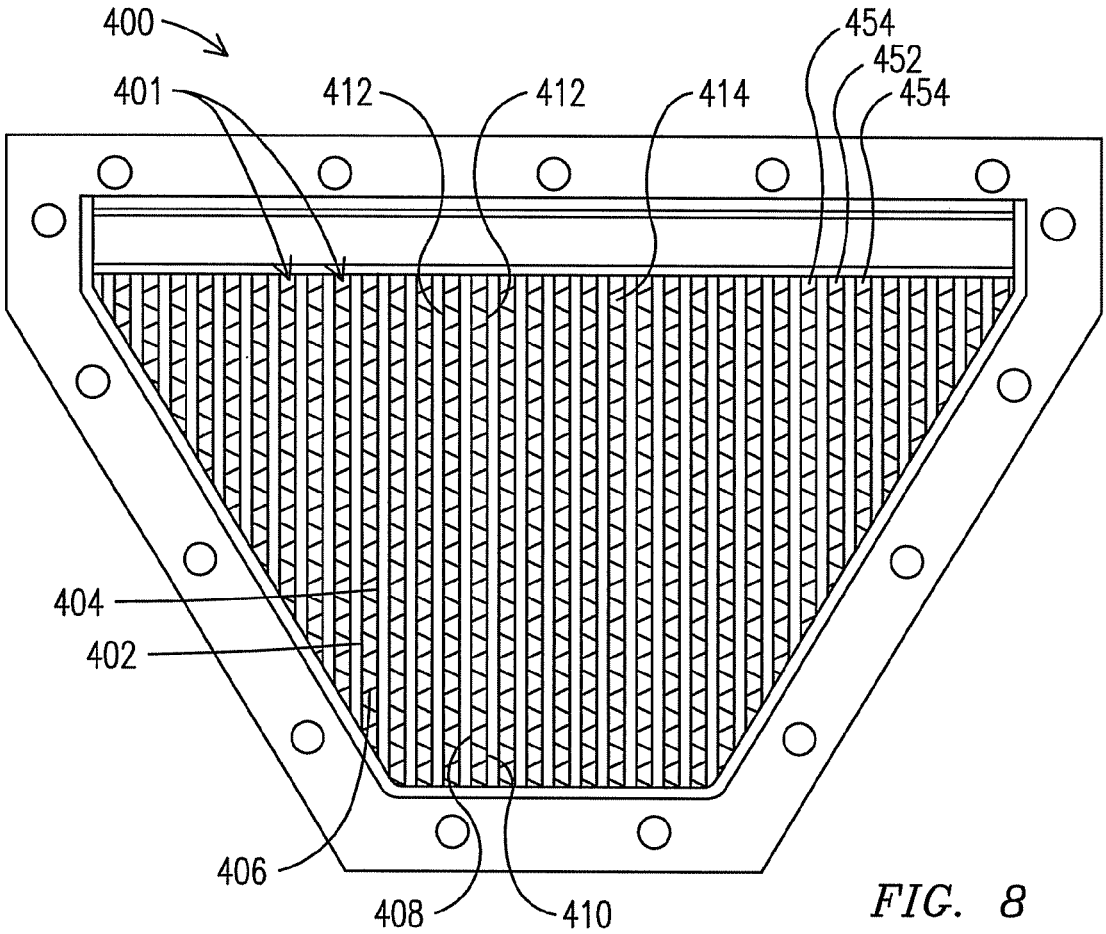
FIG. 8 is a front cross-sectional view of a hexagonal section of a catalytic combustion module according to another embodiment of the present invention.

FIG. 8 depicts an exemplary hexagonal section 400 of a catalytic oxidation module according to another aspect of the present invention. The hexagonal section 400 comprises a plurality of corrugated panels 401 having top plates 402 and bottom plates 404 attached to and affixed together by corrugated undulating members 406. The corrugated undulating members 406 have alternately formed ridges 408 and grooves 410 that respectively attach to the top plates 402 and bottom plates 404 by, for example, welding or brazing. The outer surfaces 412 of the top plates 402 and the bottom plates 404 may be coated with one or both of the catalysts 56, 60 as described above while an interior 414 of the panels 401 may be uncoated such that cooling air may be flowed within the interior 414 of the panels 401 and later mixed with a fuel/air mixture that has traversed the catalysts 56, 60 on the outer surfaces 412 of the top plates 402 and the bottom plates 404.

It is understood that it may be preferable not to coat the outer surface 412 of any of the plates 402, 404 of each corrugated panel 401 with the monometallic catalyst 56 along an entire longitudinal length of any of the plates 402, 404. If the entire length of each of the plates 402, 404 of all or most of the corrugated panels 401 were coated with the monometallic catalyst 56, the heat generated upon ignition of the monometallic catalyst 56 would likely be excessive for the particular catalytic oxidation module. Further, it is contemplated it is desirable for a plurality of the top plates 402 and bottom plates 404 to include the monometallic catalyst 56 on only a portion of the outer surface 412 because the amount of heat transfer generated upon ignition of monometallic catalyst 56 is sufficient to ignite the adjacent multi-component catalyst 60 in the catalytic oxidation module. Accordingly, in one embodiment, a plurality of the panels 401 comprise primary panels 452, which may include the monometallic catalyst 56 (on only a portion thereof) and the multi-component catalyst 60, and adjacent secondary panels 454, which may comprise solely the multi-component catalyst 60.

Figure 10:
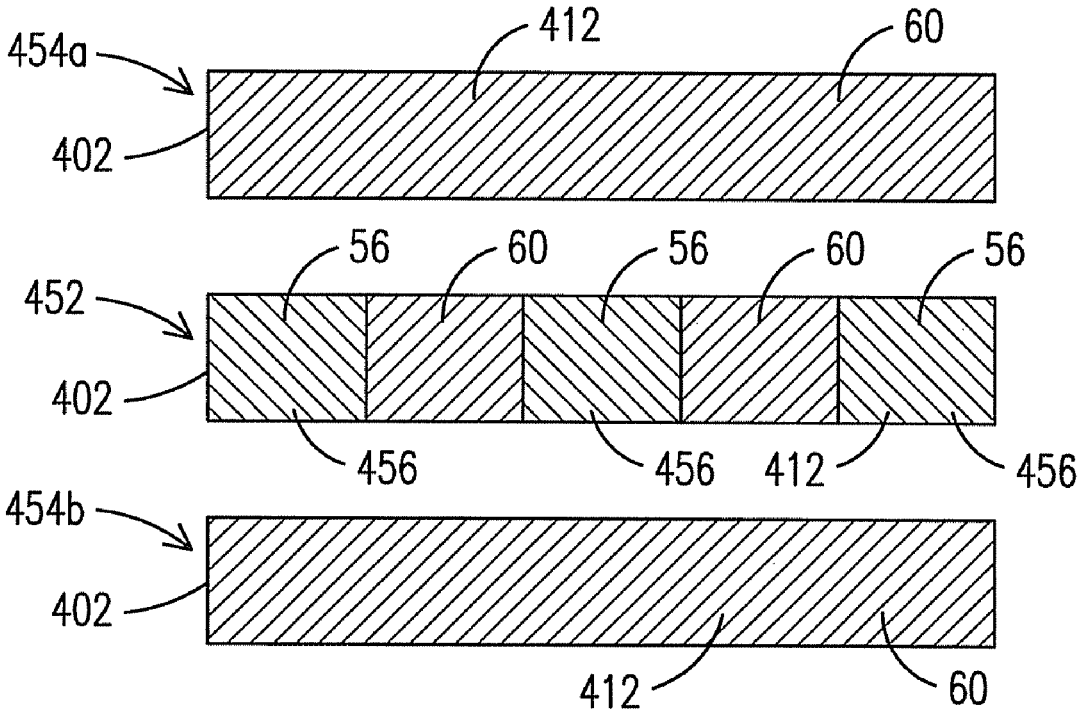
FIG. 10 is a side plan view of a primary panel having a monometallic catalyst disposed adjacent to secondary panels having a multi-component catalyst in accordance with an aspect of the present invention.

In a particular embodiment, as shown in FIG. 10, there is provided a primary panel 452 having an exemplary top plate 402. The top plate 402 comprises segments 456 of the monometallic catalyst 56 across an outer surface 412 thereof while the remainder of the outer surface 412 of the primary panel 452 comprises the multi-component catalyst 60. Conversely, as shown in FIG. 10, substantially all of the outer surface 412 of the top plates 402 of exemplary adjacent secondary panels, e.g. 454*a*, 454*b*, comprises the multi-component catalyst 60. In this way, upon ignition, the primary panels 452 comprising segments 456 of the monometallic catalyst 56 will increase their surface temperature and, via heat transfer, will increase the temperature of a passing combustion fluid flow mixture to a degree sufficient to ignite the multi-component catalyst 60 on the remainder of the outer surface 412 on the primary panels 454 and on the outer surface 412 of the adjacent secondary panels 454*a*, 454*b*. To ensure the primary panels do not produce too much heat, in an embodiment, the ratio of a total catalyst surface area ratio of monometallic catalyst 56 to a total surface area ratio of multi-component catalyst 60 in the hexagonal section 400 may be in the range of from 1:10 to 1:1000. For ease of reference, only the top plates 402 of panels 452, 454 are shown. It is understood that the bottom plates 404 of panels 452, 454 may be similarly configured.

Figure 9:
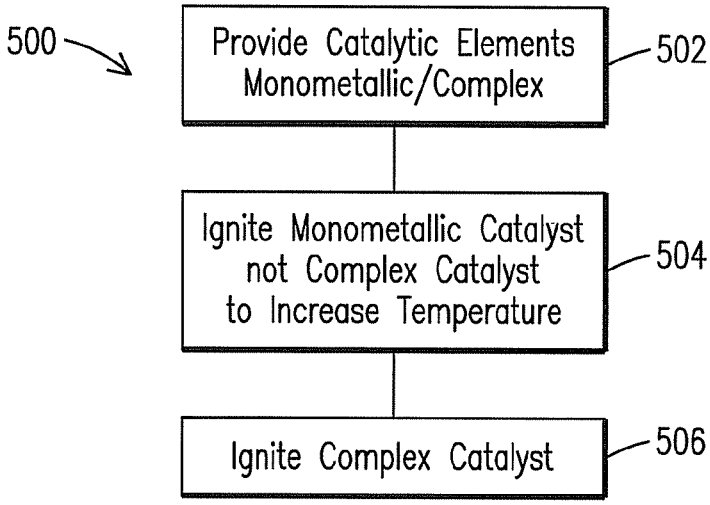
FIG. 9 is a flow diagram of an embodiment of a method in accordance with an aspect of the present invention.

As shown in FIG. 9, there is also provided a method 500 for operating a catalytic combustor in accordance with the present invention. The method 500 comprises step 502 of providing a plurality of catalytic elements, e.g. tubular elements 30, in the catalytic oxidation module 28. The catalytic elements, e.g. tubular elements 30, comprise one or more primary catalytic elements 52 as described herein comprising a monometallic catalyst 56 and a plurality of secondary catalytic elements 54 comprising a multi-component catalyst 60 as described herein adjacent the one or more primary catalytic elements 52. In addition, the method comprises step 504 of igniting the monometallic catalyst 56, but not the multi-component catalyst 60, by flowing a fuel-air mixture over the plurality of catalytic elements 52,54. Further, the method comprises step 506 of igniting the multi-component catalyst 60 of the adjacent secondary catalytic elements 54 after step 504 of igniting of the monometallic catalyst 56. In the method, the step 504 of igniting the monometallic catalyst 56 is to increase at least one of a surface temperature of the one or more primary catalytic elements 52, and, via heat transfer, is effective to increase a temperature of fuel-air mixture in the catalytic oxidation module 28 and a surface temperature of the plurality of secondary catalytic elements 54 to a degree sufficient to ignite the multi-component catalyst 60 in step 506 of the method 500.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

What we claim is:

1. A catalytic oxidation module comprising:

a plurality of spaced apart catalytic elements oriented along a flow axis for receiving a fuel mixture over a surface thereof and for discharging a partially oxidized fuel mixture at respective ends thereof, the plurality of spaced apart catalytic elements comprising:

at least one primary catalytic element comprising a monometallic catalyst deposited on at least a portion of a surface thereof; and secondary catalytic elements disposed adjacent the at least one primary catalytic element at a plane transverse to the flow axis, the plane located upstream from a downstream end of the at least one primary catalytic element, the secondary catalytic elements comprising a multi-component catalyst deposited on at least a portion of a surface thereof;

wherein ignition of the monometallic catalyst on the at least one primary catalytic element at a temperature initially insufficient to ignite the multi-component catalyst is effective to increase a temperature of the fuel mixture and a surface temperature of the at least one primary catalytic element and the secondary catalytic elements to a degree sufficient to ignite the multi-component catalyst.

2. The catalytic oxidation module of claim 1, wherein the monometallic catalyst comprises a single catalyst selected from the group consisting of a precious metal, a Group VII noble metal, a Group VIII noble metal, a transition metal, a lanthanide metal, an actinide metal, a base metal, a metal salt, and a metal oxide.

3. The catalytic oxidation module of claim 1, wherein the monometallic catalyst comprises a light off temperature of between 300° C. and 400° C. when methane or natural gas is present in the fuel mixture.

4. The catalytic oxidation module of claim 1, wherein the multi-component catalyst comprises a bi-metallic catalyst.

5. The catalytic oxidation module of claim 4, wherein the multi-component catalyst comprises at least two catalysts selected from the group consisting of a precious metal, a Group VII noble metal, a Group VIII noble metal, a transition metal, a lanthanide metal, an actinide metal, a base metal, a metal salt, a single metal oxide, and a multi-metal oxide.

6. The catalytic oxidation module of claim 4, wherein the multi-component catalyst comprises a Pt—Pd catalyst.

7. The catalytic oxidation module of claim 1, wherein the multi-component catalyst comprises at least three catalysts selected from the group consisting of a precious metal, a Group VII noble metal, a Group VIII noble metal, a transition metal, a lanthanide metal, an actinide metal, a base metal, a metal salt, a single metal oxide, and a multi-metal oxide.

8. The catalytic oxidation module of claim 7, wherein the multi-component catalyst comprises at least three metals selected from the group consisting of platinum, palladium, ruthenium, and rhodium.

9. The catalytic oxidation module of claim 1, wherein the multi-component catalyst comprises a light off temperature of greater than 400° C.

10. The catalytic oxidation module of claim 1, wherein a surface area ratio of the monometallic catalyst to the multi-component catalyst in the catalytic oxidation module is from 1:10 to 1:1000.

11. The catalytic oxidation module of claim 1, wherein the plurality of catalytic elements comprises a plurality of tubular elements, wherein the at least one primary catalytic element consists essentially of the monometallic catalyst, and wherein the at least one primary catalytic element is surrounded by secondary catalytic elements consisting essentially of the multi-component catalyst.

12. The catalytic oxidation module of claim 1, wherein the at least one primary catalytic element and a plurality of the secondary catalytic elements comprise a segment of the monometallic catalyst at a front end thereof.

13. The catalytic oxidation module of claim 1, wherein the at least one primary catalytic element and the secondary catalytic elements comprise corrugated panels, and wherein a surface area ratio of the monometallic catalyst to the multi-component catalyst on the corrugated panels is from 1:10 to 1:1000.

14. The catalytic oxidation module of claim 1, wherein the monometallic catalyst is configured to start an exothermic catalytic reaction in the catalytic oxidation module at a temperature between 300° C. and 400° C.

15. The catalytic oxidation module of claim 1, wherein the at least one primary catalytic element comprises a segment of the monometallic catalyst and a downstream segment comprising a multi-component catalyst, wherein ignition of the monometallic catalyst at a temperature initially insufficient to ignite the multi-component catalyst is effective to increase a temperature of the fuel mixture and a surface temperature of the at least one primary catalytic element to a degree sufficient to ignite the multi-component catalyst.

16. A catalytic oxidation module comprising:

a plurality of spaced apart catalytic elements for receiving a fuel mixture over a surface thereof and for discharging a partially oxidized fuel mixture at respective ends thereof, the plurality of catalytic elements comprising:

at least one primary catalytic element comprising a monometallic catalyst deposited on at least a portion of a surface thereof; and a plurality of secondary catalytic elements surrounding the at least one primary catalytic element, each of the secondary catalytic elements comprising a multi-component catalyst deposited on at least a portion of a surface thereof;

wherein ignition of the monometallic catalyst on the at least one primary catalytic element at a temperature initially insufficient to ignite the multi-component catalyst is effective to increase a temperature of the fuel mixture and a surface temperature of the at least one primary catalytic element and the plurality of secondary catalytic elements to a degree sufficient to ignite the multi-component catalyst.

17. The catalytic combustor of claim 16, wherein the monometallic catalyst has a light off temperature of between 300° C. and 400° C. when methane or natural gas is present in the fuel mixture, and wherein the multi-component catalyst has a light off temperature of greater than 400° C.

18. A gas turbine engine comprising the catalytic combustor of claim 16.

19. A method for operating a catalytic combustor comprising:

providing a plurality of catalytic elements in a catalytic oxidation module, the plurality of catalytic elements comprising at least one primary catalytic element comprising a monometallic catalyst and a plurality of secondary catalytic elements surrounding the at least one primary catalytic element comprising a multi-component catalyst;

igniting the monometallic catalyst, but not the multi-component catalyst, by flowing a fuel-air mixture over the plurality of catalytic elements; and igniting the multi-component catalyst after said igniting of the monometallic catalyst, wherein ignition of the monometallic catalyst is effective to increase a surface temperature of the at least one primary catalytic element, and, via heat transfer, is effective to increase a temperature of fuel-air mixture in the catalytic oxidation module and a surface temperature of the plurality of surrounding secondary catalytic elements to a degree sufficient to ignite the multi-component catalyst.

20. The method of claim 19, wherein the monometallic catalyst starts an exothermic catalytic reaction in the catalytic oxidation module at a temperature between 300° C. and 400° C., and wherein upon ignition of the monometallic catalyst and efficient heat transfer within the catalytic oxidation module, a chain ignition of the multi-component catalyst starts at a temperature above 400° C.

* * * * *